US006062732A

United States Patent [19]

Scott

[11] Patent Number: 6,062,732

[45] Date of Patent: May 16, 2000

[54] FLEXIBLE INTERMEDIATE BULK CONTAINER

[75] Inventor: Ray Scott, Scott, La.

[73] Assignee: Intertape Polymer Group, Truro, Canada

[21] Appl. No.: 09/113,849

[22] Filed: Jul. 10, 1998

Related U.S. Application Data

[60] Provisional application No. 60/053,851, Jul. 25, 1997.

[51] Int. Cl.[7] ..... B65D 33/14; B65D 33/01

[52] U.S. Cl. ..... 383/24; 383/41; 383/66; 383/67; 383/101; 383/102

[58] Field of Search ..... 383/67, 101, 102, 383/103, 66, 41, 24, 100

[56] References Cited

U.S. PATENT DOCUMENTS 3,097,677 7/1963 Mitchell ..... 383/103 X
3,998,255 12/1976 Mather et al. ..... 383/102
5,558,137 9/1996 Futerman ..... 383/103 X

FOREIGN PATENT DOCUMENTS 5124692 5/1993 Japan ..... 383/67
6179487 6/1994 Japan ..... 383/100

*Primary Examiner*—Jes F. Pascua
*Attorney, Agent, or Firm*—Ohlandt, Greeley, Ruggiero & Perle

[57] ABSTRACT

A flexible intermediate bulk container having a filling spout extending outwards from one end and a discharge spout extending from the opposed end. A layer of an air-permeable diaphragm and a layer of sheet internal thereto are located at the one end, the opposed end or in wall of container. The diaphragm and sheet are adapted to have a tube therein in fluid communication into the container, through which a vacuum or air pressure may be applied to facilitate filling or discharge of contents.

8 Claims, 4 Drawing Sheets

FLEXIBLE INTERMEDIATE BULK CONTAINER

This application claims the benefit of U.S. Provisional No. 60/053,851 filed Jul. 25, 1997.

FIELD OF THE INVENTION

The present invention is directed to containers known as flexible intermediate bulk containers, which are used in the shipping of semi-bulk quantities of, for instance, powdered materials e.g. fine powdered food and chemical products. In particular, the present invention relates to a flexible intermediate bulk container that is capable of being filled and emptied in a more effective manner, and to the methods of filling and emptying of the filled intermediate bulk container.

BACKGROUND OF THE INVENTION

Flexible intermediate bulk containers, also known as FIBCs, are increasingly used in the packaging and shipping of semi-bulk quantities of fine powdery food, chemical products and other powdered materials. Examples of the products that are shipped in such containers include melamine, silicon and flour. The flexible intermediate bulk container has a flexible side wall, normally in the form of a tube, with end walls having spouts thereon, one spout being for filling the container and the other spout being for discharge of the contents from the container.

Flexible intermediate bulk containers are typically filled using a gravity fill process in which the material is fed through the filling spout into the container, until such time as the container has been filled. The filling process is time consuming and may also impose hazards of an environmental and particularly an occupational health and safety nature. Dust tends to be generated in, in particular, the filling procedure and, depending on the particular product being packaged, the resultant dust cloud could be unacceptable for one or both of environmental and occupation health and safety reasons.

The typical filling process has a series of start-stop filling steps that are incorporated into the process in an attempt to ensure that the maximum capacity of the container is achieved. For instance, the flexible intermediate bulk container is filled with air so that it will maintain its proper form during the filling process. The FIBC is then placed under the dispensing spout of a hopper containing the powdered material to be packaged, with the dispensing spout of the hopper being inserted in the fill spout of the FIBC. The powdered material is slowly fed into the FIBC in an intermittent manner, to allow the flexible intermediate bulk container to de-aerate as it fills. However, this de-aeration tends to produce the dust cloud. De-aeration may be accomplished, for instance, by permitting the powdered material to settle in the FIBC and/or by application of force to the flexible part of the FIBC to urge accumulated air out of the partially-filled container. Both techniques of de-aeration are very time consuming, with the consequence that the filling of a single flexible intermediate bulk container can take as long as about 35 minutes, especially with fine powdered material.

Notwithstanding the time taken in an attempt to de-aerate the FIBC during the filling procedure, the filled flexible intermediate bulk container normally has some trapped air within the container. Thus, the FIBC is not readily stackable for transportation and there is a need to take steps to prevent a stack of the containers from shifting during transportation.

In addition to the problems in filling and transportation of FIBCs, there are problems associated with discharging the contents of the FIBC. For instance, the powdered material in the FIBC does not readily flow from the container and powdered material may pack into the corners of the FIBC and require some assistance in order to fully discharge the contents of the flexible intermediate bulk container.

Improvements in flexible intermediate bulk containers, and in both the methods of filling and discharging of such containers, are required in order to expedite the filling and discharge of the material within the container, the ability to transport filled FIBCs and to improve the environmental and especially the occupation health and safety aspects of the filling and discharging of the containers.

SUMMARY OF THE INVENTION

A flexible intermediate bulk container and methods of filling and discharging of powdered material from the flexible intermediate bulk container have now been found.

Accordingly, an aspect of the present invention provides a flexible intermediate bulk container comprising walls of flexible sheet, a first end and a second end, said first end being enclosed with a sheet having a filling spout extending outwards therefrom, said second end being enclosed with a sheet having a discharge spout therein, the walls of flexible sheet having a plurality of loops external to the container and adjacent to the first end, a layer of an air-permeable diaphragm and a layer of sheet internal thereto located at at least one of said first end, said second end and said wall of flexible sheet, said diaphragm and said sheet internal thereto having an orifice therein, said diaphragm and said sheet internal thereto being adapted to have a tube therein in fluid communication into the container.

In a preferred embodiment of the flexible intermediate bulk container of the present invention, the tube is a perforated tube located between said diaphragm and said sheet internal thereto, said tube being juxtaposed to said orifice and extending exterior to the flexible intermediate bulk container, preferably coiled around said orifice.

In a further embodiment, said diaphragm and said sheet internal thereto are located at the first end, internal to the sheet with filling spout at said first end.

In another embodiment of the present invention, said diaphragm and said sheet internal thereto are located at the second end, internal to the sheet with discharge spout at said second end.

In a still further embodiment of the present invention, said diaphragm and said sheet internal thereto are located in the wall of flexible sheet.

In another embodiment, the sheet internal to the diaphragm is a sheet of coated woven material.

In a further embodiment, at least one of the sheet at the first end and at the second end are impermeable.

A further aspect of the present invention provides a method for the filling of a flexible intermediate bulk container with a powdered material, said flexible intermediate bulk container comprising walls of flexible sheet, a first end and a second end, said first end being enclosed with a sheet having a filling spout extending outwards therefrom, said second end being enclosed with a sheet having a discharge spout therein, the walls of flexible sheet having a plurality of loops external to the container and adjacent to the first end, a layer of an air-permeable diaphragm and a layer of sheet internal thereto located at at least one of said first end, said second end and the wall of flexible sheet, said diaphragm and said sheet internal thereto having an orifice therein, said method comprising the steps of discharging said powdered material from a hopper into said flexible intermediate bulk container through said filling spout, and applying a vacuum between said diaphragm and said sheet internal thereto.

In a preferred embodiment of the method of the present invention, said container has a perforated tube around said orifice and extending exterior to the flexible intermediate bulk container, said perforated tube being located between said diaphragm and said woven sheet, said vacuum being applied between said diaphragm and said sheet internal thereto by applying a vacuum to the end of the perforated tube extending exterior to the flexible intermediate bulk container.

In a preferred embodiment of the method of the present invention, said diaphragm and said sheet internal thereto are located at the first end, internal to the sheet with filling spout at said first end.

In another embodiment of the method of the present invention, said diaphragm and said sheet internal thereto are located at the second end, internal to the sheet with discharge spout at said second end.

In a further embodiment of the method of the present invention, said diaphragm and said sheet internal thereto are located in the wall of flexible sheet.

In yet another embodiment of the method of the present invention, the vacuum is applied to said tube prior to material being dispensed from the hopper through the filling spout.

Another aspect of the present invention provides a method for the discharge of powdered material from a flexible intermediate bulk container containing said powdered material, said flexible intermediate bulk container comprising a wall of flexible sheet, a first end and a second end, said first end being enclosed with a sheet having a filling spout extending outwards therefrom, said second end being enclosed with a sheet having a discharge spout therein, the walls having a plurality of loops external to the container and adjacent to the first end, a layer of an air-permeable diaphragm and a layer of sheet internal thereto located at at least one of said first end, said second end and the wall of flexible sheet, said diaphragm and said sheet internal thereto having an orifice therein, said method comprising the steps of opening said spout at the second end to discharge powdered material from said container, and applying air pressure between said diaphragm and said sheet internal thereto.

In a preferred embodiment of the method of the present invention, said container has a perforated tube around said orifice and extending exterior to the flexible intermediate bulk container, said perforated tube being located between said diaphragm and said woven sheet, said air pressure being applied between said diaphragm and said sheet internal thereto by applying air pressure to the end of the perforated tube extending exterior to the flexible intermediate bulk container.

BRIEF DESCRIPTION OF THE DRAWINGS

The present invention will be illustrated by reference to the embodiments shown in the drawings in which.

DETAILED DESCRIPTION OF THE INVENTION

Figure 1:
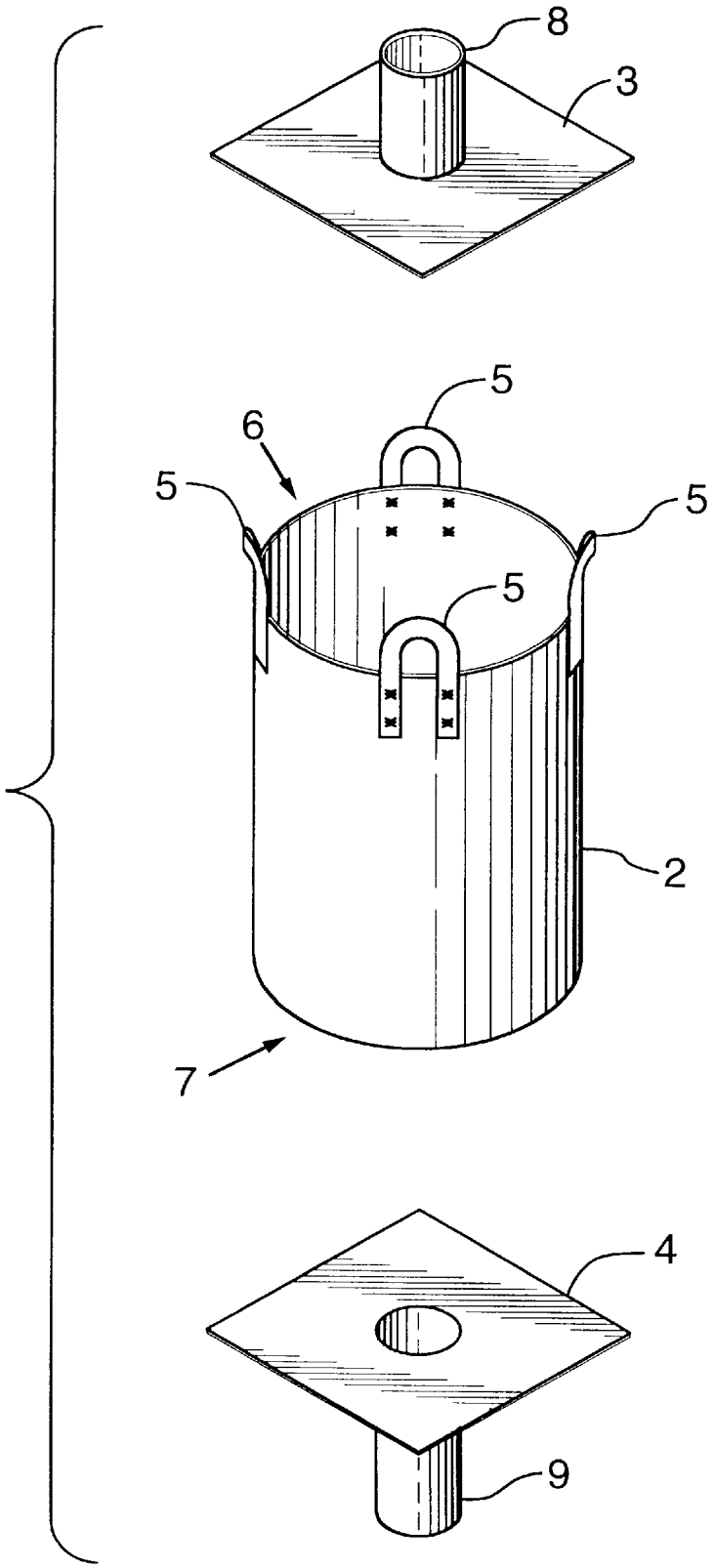
FIG.1 (PRIOR ART)
FIG. 1 is an exploded view of a schematic representation of a flexible intermediate bulk container of the prior art.

FIG. 1 shows a flexible intermediate bulk container of the prior art, generally indicated by 1. Flexible intermediate bulk container 1 has flexible tube 2, first end sheet 3 and second end sheet 4. In the embodiment of FIG. 1, flexible tube 2 is shown as an open tube, in the exploded view, and would normally be a circular tube although other shapes of tube could be used. It is also understood that the tube could be an extruded tube, or a tube formed from a sheet of material, including a U-shaped panel, in which event the first and second end described herein could be formed in situ during fabrication of the tube and not be separate pieces of sheet. The present invention will be particularly described with reference to the embodiments shown in the drawings.

Flexible tube 2 has a plurality of loops extending from the first end of the tube, such loops being exterior to tube 2. FIG. 1 shows four loops 5, but any convenient number of loops could be used. Loops 5 are used in order to hang the flexible intermediate bulk container under the spout of a hopper during the filling operation and to hang the flexible intermediate bulk container during discharge of material from the flexible intermediate bulk container.

First end sheet 3 is attached to flexible tube 2, normally by sewing the first end sheet 3 onto first end 6 of flexible tube 2. First end sheet 3 has filling spout 8 extending therefrom external to flexible tube 2. Filling spout 8 would be of a suitable diameter with respect to the filling of the container.

Second end sheet 4 is attached to second end 7, normally by stitching of second end sheet 4 to the tube at second end 7. Second end sheet 4 has dispensing tube 9 extending therefrom, which would be of a size suitable for the discharge of the contents of the flexible intermediate bulk container.

Flexible end sheet 3 is preferably an air-impermeable sheet, but could also be other material e.g. a sheet of felt or similar material. Second end sheet 4 is also preferably an impermeable sheet, and is typically a coated woven structure. Any convenient impermeable material may be used for second end sheet 4.

In operation, the flexible intermediate bulk container 1 is hung by means of loops 5 beneath a hopper containing the material to be packaged. The dispensing spout of the hopper is inserted into filling spout 8 and material is dispensed into the flexible intermediate bulk container. As discussed above, it is normal practice to use an intermittent flow of powdered material from the hopper, and to allow the powdered material to settle and for air in flexible tube 2 to discharge during the filling process. In a typical filling process, the time required in order to fill the flexible intermediate bulk container may be as long as about 35 minutes, especially with fine powdered materials, and even then the flexible intermediate bulk container that is obtained typically contains sufficient air to make stacking of the flexible intermediate bulk container difficult.

Figure 2:
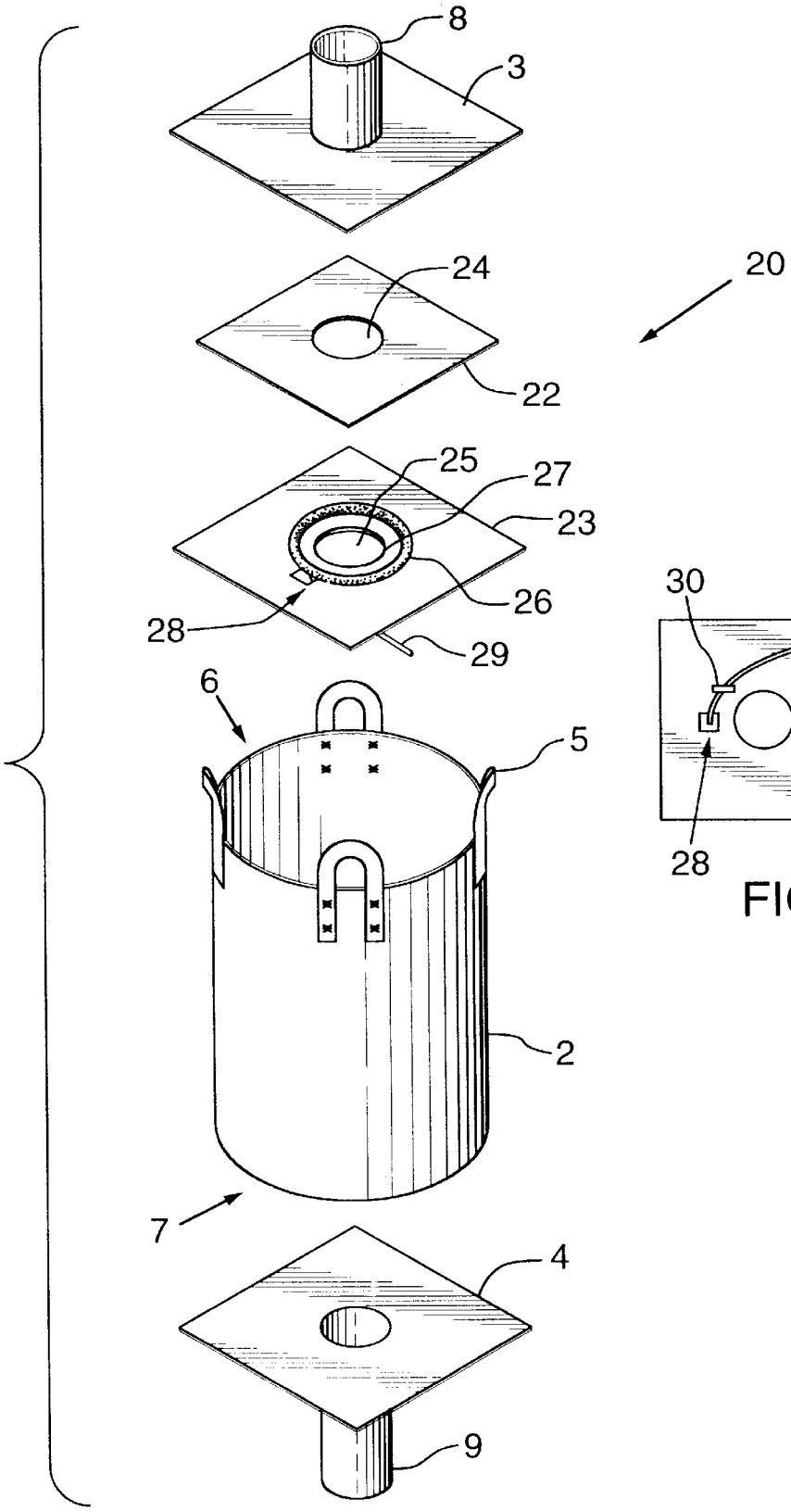
FIG. 2 is an exploded view of a schematic representation of an embodiment of a flexible intermediate bulk container of the invention.

FIG. 2 shows a flexible intermediate bulk container of the present invention, generally indicated by 20. Flexible intermediate bulk container 20 has flexible tube 2, first end sheet 3 and second end sheet 4 as described previously for the flexible intermediate bulk container of the prior art. However, in the embodiment of FIG. 2, flexible intermediate bulk container 20 has two additional sheets interposed within the container, at the first end of the container. An air permeable diaphragm 22 is attached to the underside i.e. internal side, of flexible end sheet 3. In addition, a second sheet 23 is attached internal thereto i.e. the underside as illustrated, of air permeable diaphragm 22. Thus, the first end of flexible tube 2 has first end sheet 3, diaphragm 22 and sheet 23, attached in sequence to first end 6 of tube 2, first end sheet 3 being on the external side of the flexible intermediate bulk container. Diaphragm 22 and sheet 23 have orifices 24 and 25, respectively, cooperatively aligned with filling spout 8.

The surface of sheet 23 that is facing diaphragm 22 has perforated tube 26 coiled around orifice 25 of sheet 23 juxtaposed but slightly spaced from edge 27 of orifice 25 e.g. forming an annular ring of perforated tube. Perforated tube 26 would normally be in the form of a tube having a plurality of orifices therein, particularly orifices on the part of the tube facing towards edge 27 of orifice 25. Perforated tube 26 passes through sheet 23, at passage 28 and extends external to sheet 23 to form perforated tube outlet 29. Perforated tube outlet 29 is external to the flexible intermediate bulk container, and adapted to connect to a source of vacuum or air.

Figure 2A:
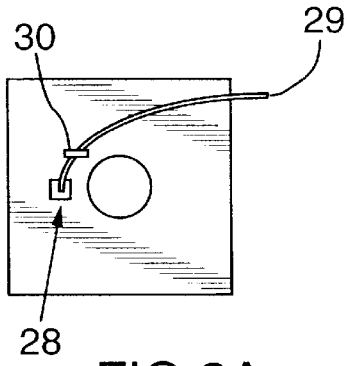
FIG. 2*a* is a schematic representation of the underside of the sheet with the tube that is in FIG. 2.

FIG. 2A shows the under (internal) side of sheet 23 i.e. the side that is towards the interior of flexible tube 2. The underside of sheet 23 has adhesive material 30 thereon juxtaposed to the orifice in second end sheet 4, to hold perforated tube 26 and perforated tube outlet 29 in place. A typical adhesive material would be hook and loop fasteners sold under the VELCRO trademark" in order to maintain the integrity of the VELCRO trademark.

The present invention is particularly described herein with reference to use of a perforated tube. It is to be understood, however, that the perforated tube coiled around the orifice could be omitted, with the layer of air permeable sheet 22 and layer of sheet 23 being adapted for insertion of a tube therebetween, so that vacuum or air pressure could be applied by inserting a tube between sheet 22 and sheet 23 and operating the method of the invention as described herein.

In operation of the embodiment of FIG. 2, the flexible intermediate bulk container is hung by means of loops 5 beneath the hopper containing the material to be packaged. The dispensing spout of the hopper is inserted into filling spout 8 and the material is dispensed into the flexible intermediate bulk container. A vacuum is applied to the perforated tube outlet 29, preferably prior to material flowing from the hopper through filling spout 8. Air is removed from around orifice 25 through perforated tube 26, creating a partial vacuum at that location. The partial vacuum serves to remove air from the flexible intermediate bulk container during the filling process, and thereby aid in the settling of the material within the flexible intermediate bulk container. It will also remove dust formed during the filling procedure.

It has been found that the typical filling time of up to 35 minutes for a flexible intermediate bulk container of the prior art may be reduced to a period of about 10 minutes using the flexible intermediate bulk container and method of the present invention.

Figure 3:
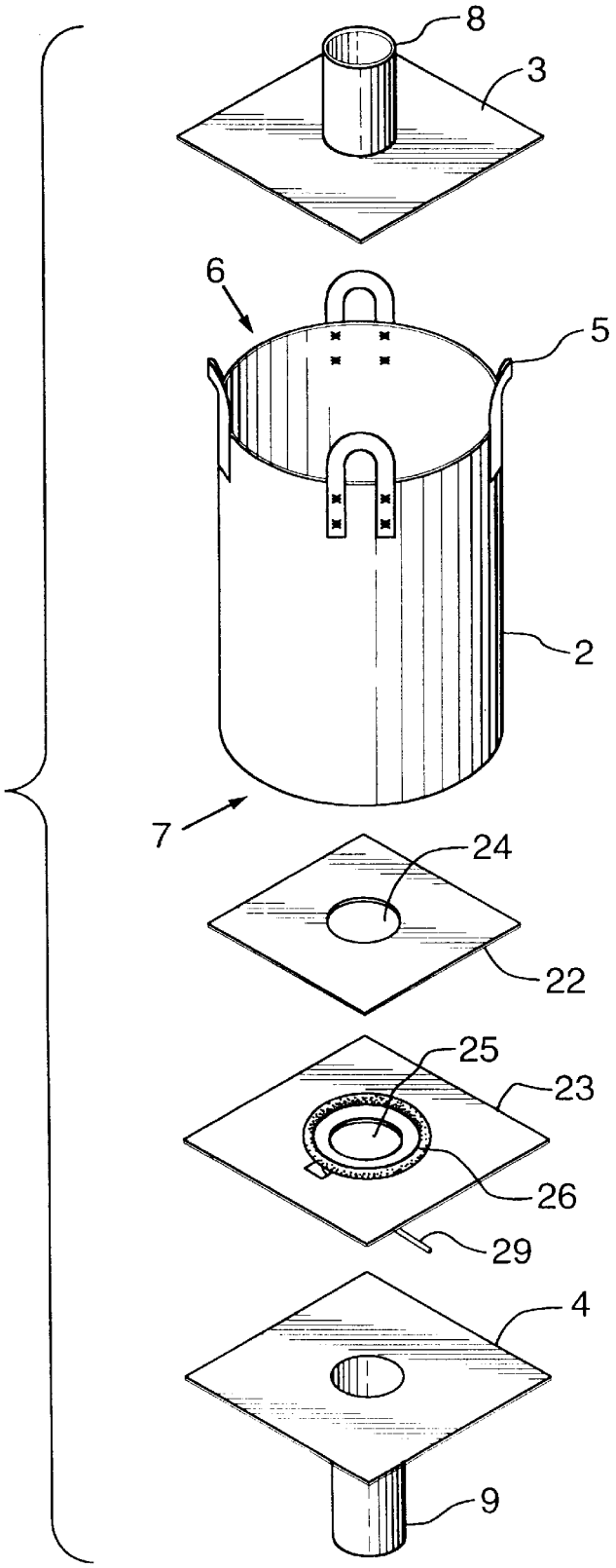
FIG. 3 is an exploded view of a schematic representation of an another embodiment of a flexible intermediate bulk container of the invention.

FIG. 3 shows the embodiment of the present invention in which diaphragm 22 and woven sheet 23 are located on second end 7 of tube 2, rather than on first end 6 of tube 2. The method of operation of embodiment of FIG. 3 is similar to that of the embodiment of FIG. 2, in that a partial vacuum is applied to perforated tube outlet 29, preferably prior to the filling of the flexible intermediate bulk container through filling spout 8.

Figure 4:
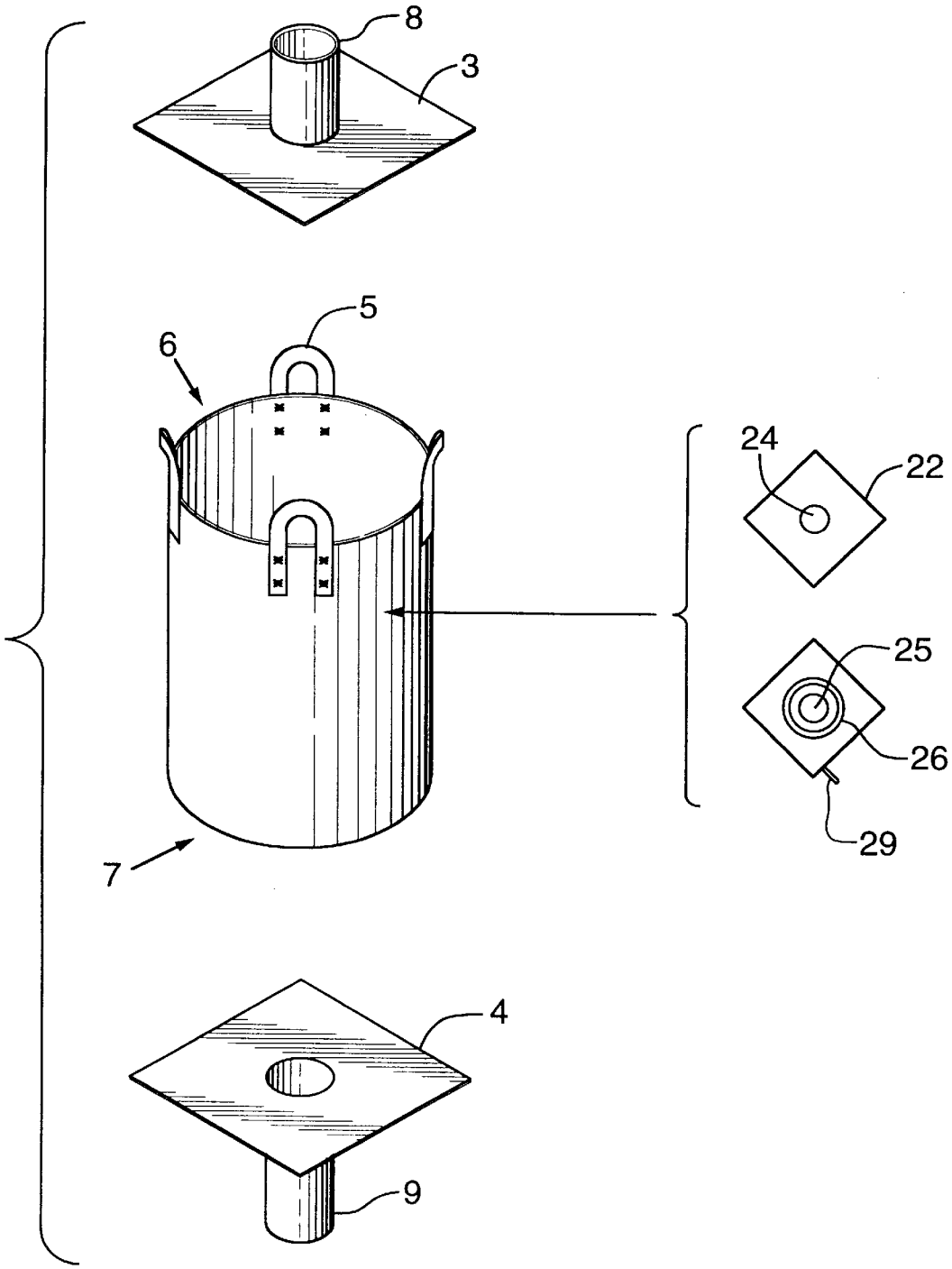
FIG. 4 is an exploded view of a schematic representation of yet another embodiment of a flexible intermediate bulk container of the invention.

FIG. 4 illustrates the embodiment of the present invention in which diaphragm 22 and woven sheet 23 are located in the side wall of tube 2, rather than at either first end 6 or second end 7 of tube 2. The method of the present invention is operated in the same manner as described previously.

The diaphragm and sheet internal thereto may be in the form of a bladder with filter, especially when located at or near the wall of the FIBC.

The perforated tube of the flexible intermediate bulk container shown in FIGS. 2–4 may also be used in the discharging of the contents of the FIBC. In order to do so, the filled FIBC is suspended by its loops over the discharge container that is to receive the contents of the FIBC. An air system is then attached to the perforated tube outlet 29. The discharge spout, 9, of the FIBC is then opened and air pressure is applied through outlet 29 of the perforated tube. The application of the air fills the FIBC with air and/or assists in forcing material out of the FIBC, and continues to do so until the FIBC has been emptied.

It has been found that the FIBC may be emptied in an effective manner, in a time that is typically about 10 minutes.

The air permeable sheets described herein are typically felt materials in flexible intermediate bulk containers, but it is to be understood that other porous sheet materials could be used as substitutes for felt. In addition, a variety of air impermeable sheet materials, including extruded sheet, coated woven materials and the like may be used in the fabrication of tube 2 and ends 3 and 4 of the FIBC.

The flexible intermediate bulk containers of the present invention, and the method of use thereof, offer significant time savings in the filling and discharge of contents of flexible intermediate bulk containers.

I claim:

1. A flexible intermediate bulk container comprising walls of flexible sheet, a first end and a second end, said first end being enclosed with a sheet having a filling spout extending outwards therefrom, said second end being enclosed with a sheet having a discharge spout therein, the walls of flexible sheet having a plurality of loops external to the container and adjacent to the first end, a layer of an air-permeable diaphragm and a layer of sheet internal thereto located at at least one of said first end, said second end and said wall of flexible sheet, said diaphragm and said sheet internal thereto having an orifice therein, said diaphragm and said sheet internal thereto having a tube therein in fluid communication into the container.

2. The flexible intermediate bulk container of claim 1 in which the tube is a perforated tube located between said diaphragm and said sheet internal thereto, said tube being juxtaposed to said orifice and extending exterior to the flexible intermediate bulk container.

3. The flexible intermediate bulk container of claim 2 in which the perforated tube is coiled around said orifice.

4. The perforated intermediate bulk container of claim 1 in which said diaphragm and said sheet internal thereto are located at the first end, internal to the sheet with filling spout at said first end.

5. The perforated intermediate bulk container of claim 1 in which said diaphragm and said sheet internal thereto are located at the second end, internal to the sheet with discharge spout at said second end.

6. The perforated intermediate bulk container of claim 1 in which said diaphragm and said sheet internal thereto are located in the wall of flexible sheet.

7. The perforated intermediate bulk container of claim 1 in which the sheet internal to the diaphragm is a sheet of coated woven material.

8. The perforated intermediate bulk container of claim 1 in which at least one of the sheet at the first end and at the second end are impermeable.

* * * * *